US010746116B2

(12) United States Patent
Jean et al.

(10) Patent No.: US 10,746,116 B2
(45) Date of Patent: Aug. 18, 2020

(54) STARTING ASSISTANCE METHOD AND DEVICE FOR AN INTERNAL COMBUSTION ENGINE

(71) Applicants: Continental Automotive France, Toulouse (FR); Continental Automotive GmbH, Hannover (DE)

(72) Inventors: Alexis Jean, Fonsorbes (FR); Yannis Guillot, Ambres (FR); Claude Courtiel, Vieillevigne (FR)

(73) Assignees: Continental Automotive France (FR); Continental Automotive GmbH (DE)

( * ) Notice: Subject to any disclaimer, the term of this patent is extended or adjusted under 35 U.S.C. 154(b) by 0 days.

(21) Appl. No.: 16/485,207

(22) PCT Filed: Feb. 17, 2017

(86) PCT No.: PCT/FR2017/050355
§ 371 (c)(1),
(2) Date: Aug. 12, 2019

(87) PCT Pub. No.: WO2018/150105
PCT Pub. Date: Aug. 23, 2018

(65) Prior Publication Data

US 2020/0011259 A1 Jan. 9, 2020

(51) Int. Cl.
*F02D 41/06* (2006.01)
*F02M 35/10* (2006.01)
*F02N 19/00* (2010.01)

(52) U.S. Cl.
CPC ..... *F02D 41/062* (2013.01); *F02M 35/10209* (2013.01); *F02N 19/00* (2013.01)

(58) Field of Classification Search
CPC .. F02D 41/062; F02D 41/064; F02D 2250/41; F02D 2200/0414;
(Continued)

(56) References Cited

U.S. PATENT DOCUMENTS 6,857,415 B2 2/2005 Kayama et al.
8,726,872 B2 5/2014 White et al.
(Continued)

FOREIGN PATENT DOCUMENTS

FR 2937381 A1 4/2010
FR 3042225 A1 4/2017
JP 07119511 A 5/1995

OTHER PUBLICATIONS

International Search Report and Written Opinion for International Application No. PCT/FR2017/050355, dated Nov. 9, 2917—10 pages.

*Primary Examiner* — Xiao En Mo
(74) *Attorney, Agent, or Firm* — RatnerPrestia

(57) ABSTRACT

A starting assistance method and device for an internal combustion engine supplied with a fuel that may contain ethanol, and including a fluid connection pipe between an intake manifold and a braking assistance device. The method including determining the engine temperature, determining the outdoor air temperature, blocking the pipe between the intake manifold and the braking assistance device for a given duration during a phase of starting the engine when the temperature of the engine is lower than a first threshold value and the outdoor air temperature is lower than a second threshold value, and freeing the pipe between the intake manifold and the braking assistance device when the engine is rotating autonomously.

12 Claims, 2 Drawing Sheets

(58) Field of Classification Search
CPC .. F02D 2200/021; F02N 19/00; F02N 19/001; F02N 2200/122; F02N 2200/0807; F02N 2200/023; F02M 35/10209; F02M 35/10229
See application file for complete search history.

(56) References Cited

U.S. PATENT DOCUMENTS

| | | | | |
|---|---|---|---|---|
| 2004/0159095 | A1 | 8/2004 | Grieser et al. | |
| 2004/0237923 | A1 | 12/2004 | Kayama et al. | |
| 2007/0234716 | A1* | 10/2007 | Hirooka | B60T 17/02 60/397 |
| 2007/0236083 | A1* | 10/2007 | Kawamori | B60T 13/52 303/114.3 |
| 2012/0065860 | A1* | 3/2012 | Isaji | B60T 13/52 701/70 |
| 2012/0138005 | A1 | 6/2012 | White et al. | |
| 2013/0276756 | A1 | 10/2013 | Leone et al. | |
| 2014/0041828 | A1* | 2/2014 | Yoshida | B60H 1/00778 165/41 |
| 2017/0259826 | A1* | 9/2017 | Martin | B60W 30/18109 |
| 2018/0058287 | A1* | 3/2018 | Zhang | F02D 41/0007 |

* cited by examiner

STARTING ASSISTANCE METHOD AND DEVICE FOR AN INTERNAL COMBUSTION ENGINE

CROSS REFERENCE TO RELATED APPLICATIONS

This application is the U.S. National Phase Application of PCT International Application No. PCT/FR2017/050355, filed Feb. 17, 2017, the contents of such application being incorporated by reference herein.

FIELD OF THE INVENTION

The present invention relates to a starting assistance method and device for an internal combustion engine that make it possible to improve the robustness of starting of the engine.

Such a method and device are applied in the automotive field, and more specifically in the field of engines supplied with a fuel containing ethanol. These engines are more often called flex-fuel engines.

BACKGROUND OF THE INVENTION

Engines supplied with ethanol and/or with a mixture of ethanol and a traditional fuel (gasoline, premium) encounter difficulties when starting at low temperature. Low temperature is understood to mean an (outdoor) air temperature lower than 5° C. (degrees Celsius). Specifically, when the engine is cold and the air temperature is lower than 5° C., it is difficult for the ethanol to combust. These difficulties are reflected in a lengthier or even impossible process of starting the engine when temperatures are particularly low.

One well-known solution involves heating the fuel mixture before it is injected into a combustion chamber. To this end, heating means are positioned on a fuel intake and heat the fuel before it is injected into the combustion chamber. This technique thus makes it possible to improve cold-starting of the engine. However, the time to start the engine (including the pre-heating time) using such a device still remains relatively lengthy, of the order a few seconds, and such a solution additionally has a relatively high cost.

Document FR 2937381, incorporated herein by reference, proposes a method for starting a combustion engine supplied with a first fuel that may contain ethanol. The engine is also equipped with an auxiliary cold-starting system including an auxiliary tank containing a second fuel having a low ethanol content, and a temperature sensor that measures a temperature of a liquid coolant of the engine. Depending on the proportion of ethanol in the first fuel and on the temperature of the liquid coolant, some of the second fuel is introduced into an engine intake in response to the observation of an event preceding a request to start the engine, such as for example unlocking and opening of a driver's door. Thus, when the starting phase is launched, the low-ethanol fuel is present in the combustion chambers, thereby improving the cold-starting of the engine.

Problems with the ability to reproduce cold-starting exist with such devices. Specifically, for example when the low-ethanol fuel tank is empty, cold-starting is difficult. In addition, adding more or less bulky and complex materials to the engine, such as for example a heating element or else a small tank, leads to problems with bulk, but also with compatibility with the surroundings of the engine.

SUMMARY OF THE INVENTION

The aim of an aspect of the present invention is therefore to improve the ability to reproduce cold-starting of engines supplied with a fuel containing ethanol, with easy integration into the surroundings of the engine. Advantageously, such a method and device will be easy to implement and will have a controlled production cost.

To this end, according to a first aspect of the invention, what is proposed is a starting assistance method for an internal combustion engine supplied with a fuel that may contain ethanol, and including a fluid connection pipe between an intake manifold and a braking assistance device, the method comprising the following steps:

determining the engine temperature, determining the outdoor air temperature, blocking the pipe between the intake manifold and the braking assistance device for a given duration during a phase of starting the engine when the temperature of the engine is lower than a first threshold value and the outdoor air temperature is lower than a second threshold value, freeing the pipe between the intake manifold and the braking assistance device when the engine is rotating autonomously.

Thus, by virtue of conditionally blocking and freeing the pipe, as defined, between the intake manifold and the braking assistance device, the evolution of the pressure in the intake manifold is able to remain identical regardless of the state of the braking device, this constituting starting assistance and improving the ability to reproduce the cold-starting of the engine. Specifically, the isolation of the braking assistance device during the starting phase makes it possible to avoid modifying the pressure in the combustion chambers and therefore varying the value of the air/fuel mixture during the starting phase. The braking assistance device is of a known type, for example a brake servo device, such as a Mastervac.

According to one advantageous feature, the pipe between the intake manifold and the braking assistance device is free at rest.

According to one advantageous feature, the first threshold value of the engine temperature is able to be set within a range of values of between 10 and 30° C. This threshold value is able to be set depending on the engine type and also on the fuel type that is used even beyond this range of values. To detect whether the engine is hot, the first threshold value of the engine temperature may however be chosen within the complete range of the temperature values of an engine.

According to one advantageous feature, the second threshold value of the outdoor air temperature is able to be set within a range of values of between 0 and 10° C. The second threshold value is able to be set depending on the engine type and also on the fuel type that is used. To optimize cold-starting of the engine, the second threshold value of the air temperature may be chosen within the complete range of the ambient air temperature values.

According to a second aspect of the invention, what is proposed is a starting assistance device for an internal combustion engine supplied with a fuel that may contain ethanol and including a fluid connection pipe between an intake manifold and a braking assistance device, characterized in that it includes:

means for determining the engine temperature, means for determining the outdoor air temperature, means for blocking the pipe between the intake manifold and the braking assistance device for a given duration during a phase of starting the engine when the temperature of the engine is lower than a first threshold value and the outdoor air temperature is lower than a second threshold value, means for freeing the pipe between the intake manifold and the braking assistance device when the engine is rotating autonomously.

According to one advantageous feature, the device according to an aspect of the invention includes:

a sensor for measuring the engine temperature, a sensor for measuring the outdoor air temperature, an electrically controlled valve arranged on the pipe connecting the intake manifold to the braking assistance device, able to block or free the pipe depending on whether the valve is respectively closed or open, and an electronic control device having a first input designed to receive the engine temperature information, a second input designed to receive the outdoor air temperature information and an output designed to drive the electrically controlled valve on the basis of the engine and outdoor air temperature information, and of threshold values relating to the engine and outdoor air temperatures, and means for determining autonomous rotation of the engine.

The electrically controlled valve makes it possible to block or to free the fluid connection pipe between the intake manifold and the braking assistance device so as to respectively prevent or permit fluid communication between these elements. The means for determining the engine temperature may be, as is known, an engine temperature sensor, that is to say a liquid coolant temperature sensor of the engine. The means for determining the outdoor air temperature may be, as is known, an outdoor air temperature sensor. The means for determining autonomous rotation of the engine are for example given by an engine control unit that possesses this information, as is known. The electronic control device is for example associated with or constitutes the engine control unit or ECU of the vehicle.

According to one advantageous feature, the electrically controlled valve is in the open position by default.

According to one advantageous feature, the electrically controlled valve has a switching time of the order of 10 ms.

According to one advantageous feature, the electronic control device has at least one programmable electronic circuit, thereby improving the integration and the modularity of the device.

According to a third aspect of the invention, what is proposed is an assembly formed of a starting assistance device according to an aspect of the invention and of an engine comprising an intake manifold, a braking assistance device, and a fluid connection pipe between the intake manifold and the braking assistance device.

BRIEF DESCRIPTION OF THE DRAWINGS

Details and advantages of aspects of the present invention will become more clearly apparent from the description that follows, given with reference to the appended schematic drawings in which.

DETAILED DESCRIPTION OF THE PREFERRED EMBODIMENTS

Figure 1:
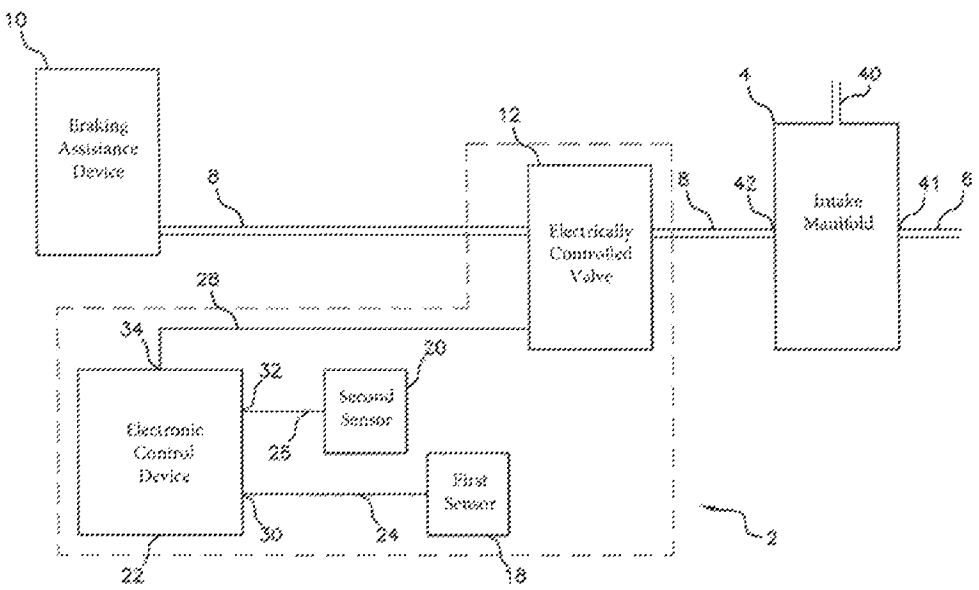
FIG. 1 is a simplified symbolic depiction of one exemplary embodiment of a starting assistance device for a combustion engine according to an aspect of the invention.

The device illustrated in FIG. 1 may be installed in a vehicle equipped with a generally four-stroke thermal combustion engine, called "flex-fuel", that is to say supplied with a fuel containing a mixture of gasoline (or premium) and ethanol. The fuel mixture injected into the engine may thus contain between 0% and 100% ethanol.

There are numerous techniques for injecting a fuel mixture into a combustion chamber, such as for example mechanical, pneumatic, direct or else indirect injection. As the structure of a direct-injection four-stroke engine is well known to those skilled in the art, it will not be presented in the remainder of the description, and the same applies for the operation thereof. Only the structural parts of the engine that interact with the device will be presented.

In the case of a direct-injection four-stroke engine, the fuel is sprayed directly into the combustion chambers of the engine, thereby allowing firstly precise control of an injected amount of fuel and allowing secondly the consumption of the vehicle to be controlled. To achieve a good-quality combustion of the fuel injected into the combustion chambers, it is necessary to achieve an optimum air/fuel mixture. For example, for a gasoline engine, the optimum air/fuel mixture is 14.7 g of air for 1 g of gasoline. This air/fuel mixture is also called stoichiometric mixture, that is to say that the combustion is theoretically complete in the combustion chamber or chambers.

The values of the air/fuel mixture are given for what is known as "normal" operation of the engine with a supply of fuel whose intrinsic characteristics are known and fixed. When the intrinsic characteristics of the fuel change, such as for example with an ethanol level of between 0% and 100%, then the optimum value of the air/fuel mixture changes so as to achieve optimum combustion.

By virtue of the widespread use of electronics in vehicles (on-board computer, electronic injection computer, also called electronic injection by those skilled in the art), the air/fuel mixture is continuously controlled, even during starting phases.

Generally, for safety reasons, the driver is asked, during a starting phase (when the vehicle is equipped for example with an electronic card), to perform a certain number of operations so that the vehicle is able to start. For example, he is asked to press both on the brake pedal and on the clutch pedal before pressing a start button that will trigger a starting procedure. In the case of a vehicle equipped with an automatic transmission, it is only necessary to press on the brake pedal.

Pressing on the brake pedal during the starting phase leads to actuation of a brake servo. The brake servo is a device that is well known to those skilled in the art that makes it possible to assist the driver in braking phases. The brake servo thus makes it possible to achieve, for a relatively low force on the brake pedal, a high hydraulic pressure in the brake circuit of the vehicle. A brake servo generally operates either using negative air pressure or using air pressure. Brake servos operating using negative air pressure are used most.

Generally speaking, for a brake servo operating using negative air pressure, this negative air pressure is taken from an intake manifold. Thus, during the starting phase, when the driver presses on the brake pedal, the brake servo draws the vacuum necessary for braking assistance from the intake manifold, which itself draws the vacuum from the various combustion chambers of the engine. The pressure in the combustion chambers is therefore modified, thereby leading to a variation in the value of the air/fuel mixture and possibly causing starting difficulties when the engine is cold. Specifically, in these conditions, firstly the value of the mixture is not optimum, and secondly the evaporation of the sprayed fuel is less significant.

FIG. 1 schematically shows a starting assistance device 2 for a combustion engine, said starting assistance device 2 including an electrically controlled valve 12, a first temperature sensor 18, a second temperature sensor 20 and an electronic control device 22, and an engine control unit (not shown) including means for determining in particular whether the engine is rotating autonomously.

FIG. 1 illustrates, highly schematically, an intake manifold 4 of the internal combustion engine with an air inlet 40, a first outlet 41 and a second outlet 42. The air inlet 40 receives outdoor air after it has passed through an air filter, not shown. The first outlet 41 is coupled to at least one combustion chamber by a first pipe 6, which is often called intake pipe by those skilled in the art. The second outlet 42 of the intake manifold 4 is coupled, by a second pipe 8, to a braking assistance device 10, such as for example a brake servo. The first pipe 6 and the second pipe 8 are generally made of an ethanol-resistant material, such as for example from synthetic material. The dimensional features of the two pipes 6 and 8 depend, inter alia, on the engine type.

The electrically controlled valve 12 is arranged on the second pipe 8, preferably as close as possible to the second outlet 42 of the intake manifold 4. The effectiveness of the device when the engine is cold-started is thus optimized. For reasons of bulk and ease of use, the electrically controlled valve 12 is preferably small. Depending on the specifications of the engine and in particular depending on the pressures that are used in the intake manifold 4, the electrically controlled valve 12 may for example operate at pressures of the order of one to two times atmospheric pressure, and may also operate under negative pressure.

For manufacturing cost reasons but also for reasons of integrating the device 2 into an existing engine, the electrically controlled valve 12 is compatible with a control voltage of 12 volts, and has for example a response time or switching time of the order of 10 ms (1 ms=0.001 s). The electrically controlled valve 12 is also often called solenoid valve by those skilled in the art.

The first temperature sensor 18 is designed to accurately measure the temperature of the engine and deliver temperature information to an electronic device 22 via a first connector 24. The first temperature sensor 18 is preferably positioned in a pipe of the cooling system of the engine in which a liquid flows. The first temperature sensor 18 that is used is a sensor model which is standard in the automotive industry, such as for example a passive temperature sensor.

The second temperature sensor 20 is designed to measure an air temperature and deliver air temperature information to the electronic device 22 through a second connector 26. The second temperature sensor 20 is preferably a generic automotive sensor that is well known to those skilled in the art. For example, the second temperature sensor 20 is positioned on an engine radiator grille of the vehicle.

The electronic control device 22 includes at least one programmable electronic circuit such as an FPGA (field-programmable gate array) circuit coupled to control and monitoring circuits that make it possible, on the basis of a program and of a given strategy, to control the valve 12.

The electronic control device 22 has a first input 30 designed to receive the temperature information from the first temperature sensor 18 through its first connector 24, and a second input 32 designed to receive the temperature information from the second temperature sensor 20 through its second connector 26. The electronic control device 22 also has an output 34 designed to drive the electrically controlled valve 12 through the third connector 28.

In one preferred embodiment, the electronic control device 22 and/or the first temperature sensor 18 and/or the second temperature sensor 20 are those of the vehicle in which the device 2 is installed, the electronic device 22 constituting for example the engine control unit of the vehicle. The device 2 thus has a very low cost price.

The first connector 24, the second connector 26 and the third connector 28 are for example sheathed electrical cables able to resist relatively large temperature variations and electromagnetic interference generated by the engine.

The device 2 as described above is able to implement the starting assistance method according to an aspect of the invention that will now be described.

Figure 2:
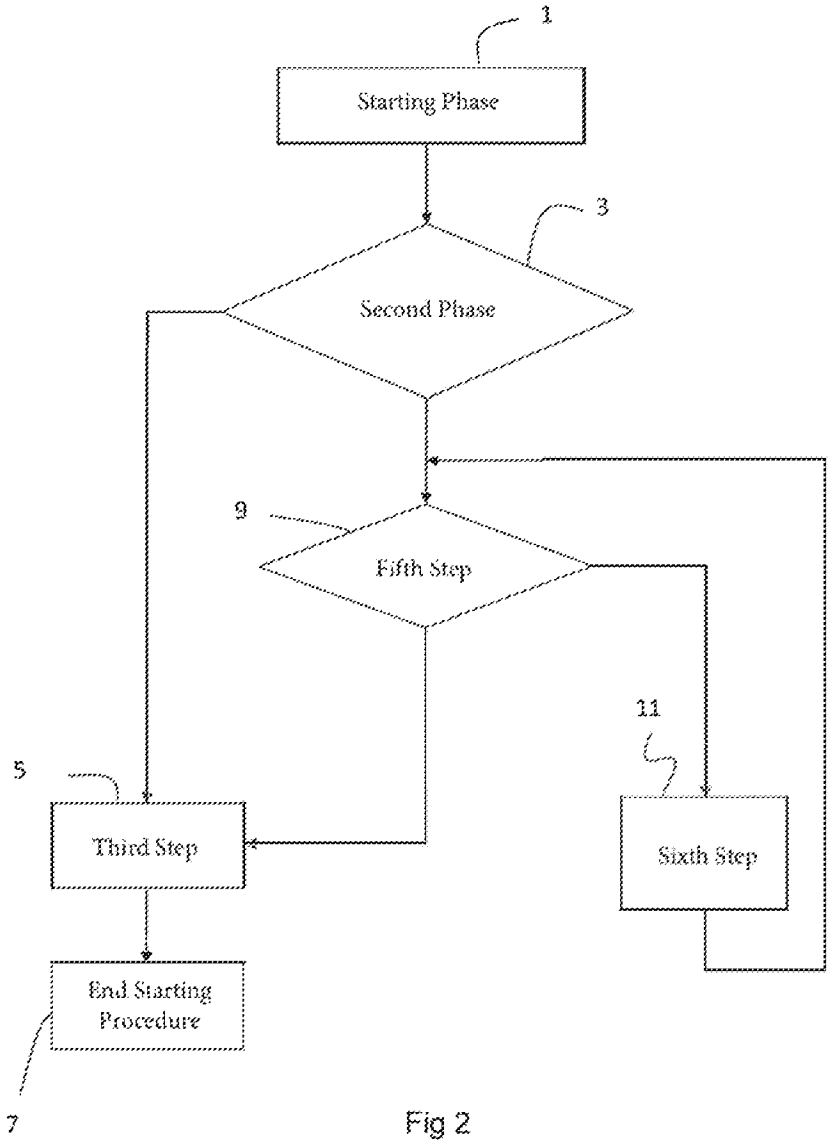
FIG. 2 is a flowchart showing various steps of exemplary embodiments of a starting assistance method according to an aspect of the invention for an internal combustion engine.

The remainder of the description will use the flowchart according to FIG. 2 to present the main steps of examples of a starting assistance method for a combustion engine supplied with a fuel that may contain ethanol.

A starting phase begins for example when the doors of the vehicle are unlocked, followed by opening of the driver's door. The starting phase represented by block 1 in FIG. 2 may thus be launched when an electronic starting card is inserted into a card reader of the vehicle and the driver presses for example simultaneously on the brake pedal and on the clutch pedal (engine off). It is important to note that, for safety reasons, the electrically controlled valve 12 is in the open position by default.

Thus, upon the detection of a starting phase by the electronic control device 22, a second phase represented by block 3 is executed. In this second phase, the first temperature sensor 18 measures the temperature of the liquid of the cooling system of the engine and transfers the temperature information to the electronic control device 22 through the first connector 24. Likewise, the second temperature sensor 20 measures the outdoor air temperature and transfers the information to the electronic control device 22 through the second connector 26. The temperature information from the two temperature sensors 18 and 20 is for example averaged with a number of taken samples of between 2 and N for a given duration able to be set by the electronic control device 22. The risk of potential measurement interference and/or aberrations is thus reduced.

A first threshold value, which may be chosen within the complete range of the temperature values of an engine, is determined for the first temperature sensor 18. However, this threshold value will preferably be chosen within a small range ranging for example from 10 to 30° C. In the following example, this first threshold value will be chosen to be 20° C.

Likewise, a second threshold value, which may be chosen within the complete range of the ambient air temperature values, is determined for the second temperature sensor 20. However, this threshold value will preferably be chosen within a small range ranging for example from 0 to 10° C. In the following example, this second threshold value will be chosen to be 5° C.

The first and second threshold values are recorded in memory in the engine control unit of the vehicle (these not being shown) in order to be available for the electronic device 22 for driving the valve 12.

In block 3 of the flowchart shown in FIG. 2, the electronic device 22 compares the engine temperature measured by way of the first temperature sensor 18 with the first threshold value, and compares the outdoor air temperature measured by way of the second temperature sensor 20 with the second threshold value.

According to block 3 shown in FIG. 2, the condition is: outdoor air temperature lower than the second threshold value and engine temperature lower than the first threshold value.

Depending on the temperature firstly of the ambient or outdoor air measured by the second sensor 20, and secondly of the engine measured by the first sensor 18, several scenarios arise, which are presented below:

Air temperature lower for example than 5° C.:

Case no. 1: engine temperature for example lower than 20° C.

When the outdoor air temperature is lower than the second threshold value 5° C. and the temperature of the liquid of the cooling system of the engine is lower than the first threshold value 20° C. according to block 3, then a fifth step of the method, according to block 9 shown in FIG. 2, is activated.

In this fifth step, the electronic control device 22 detects whether the engine is rotating autonomously, that is to say whether the engine has actually started. This autonomous rotation information originates for example from an engine control unit of the vehicle, as is known.

Engine not rotating autonomously:

If the engine is not rotating autonomously, then a sixth step is executed. During this sixth step illustrated by block 11 in FIG. 2, the solenoid valve is actuated by the electronic control device 22, that is to say that it is closed. The response time of the electrically controlled valve 12 is 10 ms, thereby allowing fast closure thereof. The negative pressure present in the intake manifold 4 is therefore virtually not evacuated to the braking assistance device 10 upon pressing on the brake pedal.

Once the electrically controlled valve 12 has been closed, the intake manifold 4, and with it the combustion chambers, are isolated from the braking assistance device 10. It is thus possible to depressurize the combustion chambers more quickly. Furthermore, this is able to be reproduced, since the state of the brake servo does not influence the pressure prevailing in the combustion chambers.

By virtue of maintaining a low pressure, or in other words by virtue of the negative pressure maintained in the combustion chambers, starting of the engine is facilitated even when the fuel mixture contains 100% ethanol. Specifically, when the combustion chambers are under negative pressure, the amount of evaporated ethanol is higher, thereby making it possible to ensure a good air/fuel mixture.

Thus, by virtue of the negative pressure maintained in the combustion chambers, the evaporation of the ethanol is improved, thereby facilitating inflammation thereof and therefore facilitating starting of the engine.

Engine rotating autonomously:

When the electronic control device 22 detects that the engine has been rotating autonomously for a predetermined duration, more than 1 s for example, then the third step of the method according to block 5 shown in FIG. 2 is executed. Thus, according to block 5, the electrically controlled valve 12 that was closed is now opened again (default position). The brake servo is thus again able to draw the pressure from the intake manifold 4 in order again to be able to activate the braking assistance, and the starting procedure may end according to block 7 shown in FIG. 2, according to which the end of the procedure is reached, the solenoid valve remaining open by virtue of its rest position in the example.

The case in which the condition of block 3 according to FIG. 2, as defined above, is not satisfied is now studied.

Case no. 2: engine temperature higher than 20° C.

When the temperature of the liquid of the cooling system is higher than the first threshold value, chosen in the present example to be 20° C., then the engine is considered to be hot by the electronic control device 22. In this case, a third step represented by block 5 in FIG. 2 is executed.

During this third step according to said block 5, the electrically controlled valve 12, which is open by default in the example, is not actuated by the electronic control device 22, that is to say that it is not closed and the starting procedure may continue until the engine has started. The end of the starting procedure (autonomous rotation of the engine) is shown by block 7 already described above.

Air temperature higher than 5° C.:

Case no. 3: engine temperature lower than 20° C.

Although the temperature of the liquid of the cooling system is lower than the first threshold value, the electronic control device 22 considers that the engine is hot enough since the air temperature is higher than the second threshold value (as a reminder, 5° C. in the present illustrative and nonlimiting example). In this case, the third step represented by block 5, according to which the solenoid valve for isolating the braking assistance device is not controlled, is executed.

During this third step according to block 5, as already mentioned above, the electrically controlled valve 12, which is open by default, is not actuated by the electronic control device 22. The starting procedure may continue until the engine has started. The end of the starting procedure (autonomous rotation of the engine) is shown by block 7 already described above.

The temperature threshold values of the engine and of the air have been given to illustrate the operation of the device, and these are of course able to be set depending on the engine type and on the amount of ethanol contained in the fuel.

By virtue of the device and of the method presented above, the starting of engines supplied with a fuel mixture containing ethanol is able to be reproduced. An aspect of the present invention thus provides means for improving the ability to reproduce starting of an engine supplied with a fuel mixture containing ethanol at cold temperatures, that is to say lower than 5° C.

An aspect of the present invention may also be applied and/or installed in vehicles that are not equipped with an electronic starting management or automation device. The present invention may thus be used in vehicles using standard keys.

The invention claimed is:

1. A starting assistance method for an internal combustion engine supplied with a fuel that may contain ethanol and including a fluid connection pipe between an intake manifold and a braking assistance device, the method comprising:

determining an engine temperature, determining an outdoor air temperature, preventing fluid communication through the pipe between the intake manifold and the braking assistance device for a given duration during a phase of starting the engine when the temperature of the engine is lower than a first threshold value and the outdoor air temperature is lower than a second threshold value, and permitting fluid communication through the pipe between the intake manifold and the braking assistance device when the engine is rotating autonomously.

2. The method as claimed in claim 1, wherein the pipe between the intake manifold and the braking assistance device permits fluid communication therethrough at rest.

3. The method as claimed in claim 1, wherein the first threshold value of the engine temperature is able to be set within a range of values of between 10 and 30° C.

4. The method as claimed in a claim 1, wherein the second threshold value of the outdoor temperature is able to be set within a range of values of between 0 and 10° C.

5. A starting assistance device for an internal combustion engine supplied with a fuel that may contain ethanol and including a fluid connection pipe between an intake manifold and a braking assistance device, the device comprising:

means for determining an engine temperature, for determining an outdoor air temperature, means for preventing fluid communication through the pipe between the intake manifold and the braking assistance device for a given duration during a phase of starting the engine when the temperature of the engine is lower than a first threshold value and the outdoor air temperature is lower than a second threshold value, and means for permitting fluid communication through the pipe between the intake manifold and the braking assistance device when the engine is rotating autonomously.

6. The device, as claimed in claim 5, further comprising:

a sensor for measuring the engine temperature, a sensor for measuring the outdoor air temperature, an electrically controlled valve arranged on the pipe connecting the intake manifold to the braking assistance device, able to prevent or permit fluid communication through the pipe depending on whether the valve is respectively closed or open, and an electronic control device having a first input designed to receive the engine temperature information, a second input designed to receive the outdoor air temperature information and an output designed to drive the electrically controlled valve on the basis of the engine and outdoor air temperature information, and of threshold values relating to the engine and outdoor air temperatures, and means for determining autonomous rotation of the engine.

7. The device as claimed in claim 6, wherein the electrically controlled valve is in the open position by default.

8. The device as claimed in claim 6, wherein the electrically controlled valve has a switching time of the order of 10 ms.

9. The device as claimed in claim 6, wherein the electronic control device has at least one programmable electronic circuit.

10. An assembly comprising, a starting assistance device as claimed in claim 5, the assembly further comprising an engine including an intake manifold, a braking assistance device, and a fluid connection pipe between the intake manifold and the braking assistance device.

11. The method as claimed in claim 2, wherein the first threshold value of the engine temperature is able to be set within a range of values of between 10 and 30° C.

12. The device as claimed in claim 7, wherein the electrically controlled valve has a switching time of the order of 10 ms.

* * * * *